US012302959B1

(12) United States Patent
Wilson et al.

(10) Patent No.: US 12,302,959 B1
(45) Date of Patent: May 20, 2025

(54) NECK LACERATION PREVENTION DEVICE

(71) Applicant: LeV Innovations LLC, Wilmington, DE (US)

(72) Inventors: Lynn D. Wilson, Westport, CT (US); Robert L. Stevenson, Boca Raton, FL (US)

(73) Assignee: LeV Innovations LLC, Wilmington, DE (US)

( * ) Notice: Subject to any disclaimer, the term of this patent is extended or adjusted under 35 U.S.C. 154(b) by 0 days.

(21) Appl. No.: 18/921,270

(22) Filed: Oct. 21, 2024

Related U.S. Application Data

(60) Provisional application No. 63/548,117, filed on Nov. 10, 2023, provisional application No. 63/547,491, filed on Nov. 6, 2023.

(51) Int. Cl.
*A41D 13/05* (2006.01)

(52) U.S. Cl.
CPC ..... *A41D 13/0512* (2013.01)

(58) Field of Classification Search
CPC ..... A41D 13/0512; F41H 1/02
USPC ..... 2/468
See application file for complete search history.

(56) References Cited

U.S. PATENT DOCUMENTS 3,707,004 A * 12/1972 Kapitan ..... A42B 3/0473 128/206.28
4,324,003 A 4/1982 Johnston
4,449,251 A * 5/1984 Gauthier ..... A41D 13/0512 2/468
4,686,710 A 8/1987 Marston et al.
6,038,701 A * 3/2000 Regan ..... A41D 13/0512 2/125
6,044,498 A 4/2000 Schumann et al.
6,163,891 A 12/2000 Viitalahti
(Continued)

FOREIGN PATENT DOCUMENTS

AT 517915 A1 5/2017
CA 2299542 A1 8/2001
(Continued)

OTHER PUBLICATIONS

Invitation to Pay Additional Fees and, Where Applicable, Protest Fee mailed Dec. 31, 2024 in International Application No. PCT/US2024/053058.
(Continued)

*Primary Examiner* — Tajash D Patel
(74) *Attorney, Agent, or Firm* — Crowell & Moring LLP

(57) ABSTRACT

Hockey players are at risk of laceration injuries to the neck, which can be fatal. Neck guards with cut-resistant material are available but have deficiencies that limit the safety protection that they can provide. The neck laceration prevention devices of the embodiments presented herein can provide improved safety. In one example embodiment, a neck laceration prevention device comprises a protective portion and a support portion attached to the protective portion. The protective portion comprises a cut-resistant material and is shaped to protect vascular structures inferior to a base of skull entry and/or a submental/submandibular region of a wearer of the neck laceration prevention device. The support portion is configured to maintain a position of the protective portion on the wearer of the neck laceration prevention device.

5 Claims, 10 Drawing Sheets

(56) References Cited

U.S. PATENT DOCUMENTS

| | | | | |
|---|---|---|---|---|
| 8,397,316 | B2 | 3/2013 | Rosen et al. | |
| 8,950,012 | B2 * | 2/2015 | Ilges | A42B 1/06 2/9 |
| 10,905,180 | B1 | 2/2021 | Minaev et al. | |
| 11,206,879 | B2 * | 12/2021 | Peterson | A42B 3/105 |
| D975,967 | S * | 1/2023 | Wallach | D2/854 |
| 11,549,203 | B2 | 1/2023 | Nieminen et al. | |
| 11,963,562 | B1 * | 4/2024 | Grieco | A41D 3/005 |
| 2009/0064385 | A1 * | 3/2009 | Crossman | F41H 1/04 2/6.6 |
| 2011/0162131 | A1 * | 7/2011 | Harty | A42B 3/0473 2/413 |
| 2013/0232654 | A1 | 9/2013 | Camillo | |
| 2020/0008505 | A1 * | 1/2020 | Ebrahim | A42B 1/225 |
| 2020/0154799 | A1 * | 5/2020 | Morgan | A61B 5/1112 |
| 2021/0337894 | A1 * | 11/2021 | Polley-Hoffman | A41D 13/1107 |
| 2022/0338568 | A1 * | 10/2022 | Weiss | A41D 13/015 |
| 2023/0030890 | A1 * | 2/2023 | Baggen | F41H 5/0485 |
| 2023/0037729 | A1 * | 2/2023 | Han | B07C 5/00 |
| 2024/0065350 | A1 * | 2/2024 | Lakota | A62B 17/04 |
| 2024/0260701 | A1 * | 8/2024 | Hogg | A42B 1/019 |
| 2024/0349823 | A1 * | 10/2024 | Coffman | A41D 1/04 |

FOREIGN PATENT DOCUMENTS

| | | | | |
|---|---|---|---|---|
| CA | 2313872 | A1 | 1/2002 | |
| CN | 204032434 | U | 12/2014 | |
| CN | 205512469 | U | 8/2016 | |
| CN | 106510045 | A | 3/2017 | |
| CN | 215775697 | U | 2/2022 | |
| CN | 217851531 | U | 11/2022 | |
| DE | 20 2019 000 586 | U1 | 3/2019 | |
| KR | 200227533 | Y1 | 6/2001 | |
| WO | WO-2015061663 | A1 * | 4/2015 | A41D 13/0512 |
| WO | WO 2023091074 | | 5/2023 | |

OTHER PUBLICATIONS

"Balaclava mask below chin"; web search results; downloaded from the Internet at https://www.bing.com/images/search?view=detailV2&ccid=4yBI180F&id=BFFA11D907AD0418A86462F0EC9FA527AAE5A on Oct. 20, 2024; 1 page.

G8RSkin IceTM website product page; downloaded from the Internet at https://g8rtech.com/ on Nov. 14, 2023; G8RTech, LLC; 2023; 6 pages.

Hockey Monkey; Neck Guards; Hockey Monkey website product listing; downloaded from the Internet at https://www.hockeymonkey.com/accessories/protective/neck-guards.html on Nov. 14, 2023; Hockey Monkey; 2023; 3 pages.

Johnson, B; "After a hockey player's death, an NHL star makes a choice"; downloaded from the Internet at *After Adam Johnson's death, T.J. Oshie tests neck guard shirts—The Washington Post* on Oct. 20, 2024; The Washington Post; Nov. 4, 2023; 4 pages.

Loyd, Ph.D., A.M. et al.; "The Most Cut-Resistant Neck Guard for Preventing Lacerations to the Neck"; Clinical Journal of Sport Medicine, 25, No. 3; May 2015; 14 pages.

Pure Hockey; Hockey Wrist Guards & Hockey Neck Guards; Pure Hockey website product listing; downloaded from the Internet at https://www.purehockey.com/c/hockey-protective-neck-wrist-guards on Nov. 14, 2023; 2023; 10 pages.

Rutherford, Jeremy; "Why hasn't USA Hockey mandated neck guards after Adam Johnson's death? Its chief medical officer explains"; downloaded from the Internet at https://www.nytimes.com/athletic/5041297/2023/11/09/usa-hockey-neck-guards-adam-johnson/ on Oct. 20, 2024; The Athletic Media Company, A New York Times Company; Nov. 9, 2023; 6 pages.

SlashPRO; SlashPRO® Slash Resistant Neck Guard; SlashPRO website product page; downloaded from the Internet at https://www.slash-pro.com/upper-body/slash-resistant-neck-guard on Nov. 14, 2023; 2023; 4 pages.

Ice Warehouse; "CCM NP130 Cut Resistant Neck Guard Shirt Review"; YouTube product review video; downloaded from the Internet at https://www.youtube.com/watch?v=wH4ACyp7_h8 on Oct. 20, 2024; YouTube; Nov. 2023; 2 pages.

Seirus Men's Thermax Headliner; product sales page; downloaded from the Internet at *Seirus Men's Thermax Headliner | Dick's Sporting Goods* (dickssportinggoods.com) on Oct. 20, 2024; Dick's Sporting Goods; 2024; 5 pages.

Skate Armor; "Skate Armor Neck Guard"; YouTube product review video; downloaded from the Internet at https://www.youtube.com/watch?v=cdligYjYHi4 on Oct. 20, 2024; YouTube; Apr. 1, 2022; 2 pages.

Skate Armor; "Skate Armor Impact neck guard comparison"; YouTube product comparison video; downloaded from the Internet at https://www.youtube.com/watch?v=kcFm22_17M0 on Oct. 20, 2024; YouTube; Dec. 21, 2021; 2 pages.

"USA Hockey Continues to Recommend Use of Neck Guards and Cut-Resistant Socks, Sleeves, Undergarments"; downloaded from the Internet at *USA Hockey Continues to Recommend Use of Neck Guards and Cut-Resistant Socks, Sleeves, Undergarments* on Oct. 20, 2024; USA Hockey; Nov. 3, 2023; 3 pages.

Skate Armor website home page; downloaded from the Internet at *Skate Armor | #1 Best Rated Hockey Neck Guard* (dkate-armor.com) on Oct. 20, 2024; 2024; 4 pages.

G8RSkin Shiesty; website product page; downloaded from the Internet at *G8RSkin Shiesty—G8RTech* on Oct. 20, 2024; G8RTech, Inc.; 2024; 3 pages.

Lee, M.; "Death of hockey player Adam Johnson puts neck guards into new focus"; Scripps News Milwaukee; downloaded from the Internet at *Death of hockey player Adam Johnson puts neck guards into new focus* on Oct. 20, 2024; ABC 13 KTNV Las Vegas: Oct. 30, 2023; 4 pages.

Warroad.com "Shop the Pro Selection"; screenshot taken at 12:39 p.m., Jan. 14, 2025; 1 page.

"Tilo Cut Protection Collection"; Warroad website Tilo Cut Protection product page; downloaded from the Internet at https://warroad.com on Jan. 14, 2025; WARROAD; 2025; 61 pages.

Purehockey.com "Bauer Neckprotect Long Sleeve Baselayer Top—Adult"; screenshot taken at 12:39 p.m., Jan. 14, 2025; 1 page.

"Bauer Neckprotect Long Sleeve Baselayer Top—Adult"; Pure Hockey website baselayer top product page; downloaded from the Internet at https://www.purehockey.com/product/bauer-neckprotect-long-sleeve-baselayer-top-adult/itm/47766-42/ on Jan. 14, 2025; Pure Hockey; 2025; 11 pages.

Titanbattlegear.com "Shop Battlegear"; screenshot taken at 12:39 p.m., Jan. 14, 2025; 1 page.

"Shop Battlegear"; Titan Battlegear hockey neck guard shirt product page; downloaded from the Internet at https://www.titanbattlegear.com/ on Jan. 14, 2025; Titan Battlegear; 2025; 9 pages.

"Apparel for Homeland & Private Security"; retrieved from the Internet on Dec. 18, 2024 at https://web.archive.org/web/20210305075642/http://cut-tex.com/applications/slash-resistant-clothing; Cut-Tex Pro; Mar. 5, 2021; 5 pages.

International Search Report mailed Mar. 14, 2025 for International Application No. PCT/US2024/053058.

Written Opinion mailed Mar. 14, 2025 for International Application No. PCT/US2024/053058.

* cited by examiner

Jugular Veins

NECK LACERATION PREVENTION DEVICE

CROSS-REFERENCE TO RELATED APPLICATIONS

This application claims the benefit of U.S. Provisional Patent Application No. 63/547,491, filed Nov. 6, 2023 and U.S. Provisional Patent Application No. 63/548,117, filed Nov. 10, 2023, both of where are hereby incorporate by reference herein.

BACKGROUND

Ice hockey, which has approximately one-million players in North America, is an inherently-dangerous sport. Laceration injury to the neck caused by another player's skates has been documented. A player with a laceration injury to the neck may require immediate medical intervention to survive. Unfortunately, trained staff may not be available on-site, and, even with trained medical professionals within 100 feet of the afflicted, some laceration injuries to the neck have resulted in death. Neck guards with cut-resistant material are available but are not currently mandated by the National Hockey League, although neck guards are mandated in some levels of play/leagues (e.g., youth programs).

DETAILED DESCRIPTION

As mentioned above, neck guards with cut-resistant material are available to help protect against laceration injuries to the neck. However, currently-available neck guards may not be able to provide sufficient safety. The neck laceration prevention devices of the embodiments presented herein provide improved safety. Before turning to those embodiments, the following paragraphs provide an overview of some of the deficiencies of currently-available neck guards.

Figure 1:
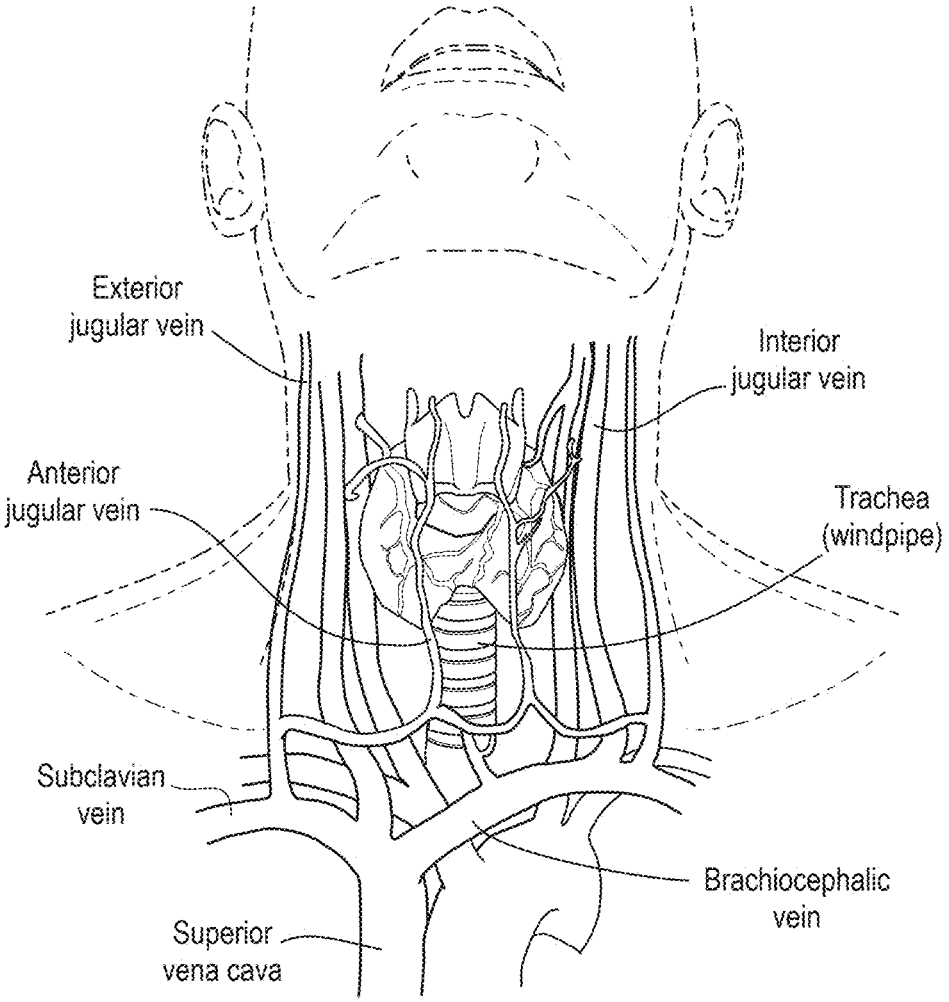
FIG. 1 PRIOR ART
FIG. 1 is a prior art diagrammatic front view of the neck venous system in human anatomy.
Figure 2:
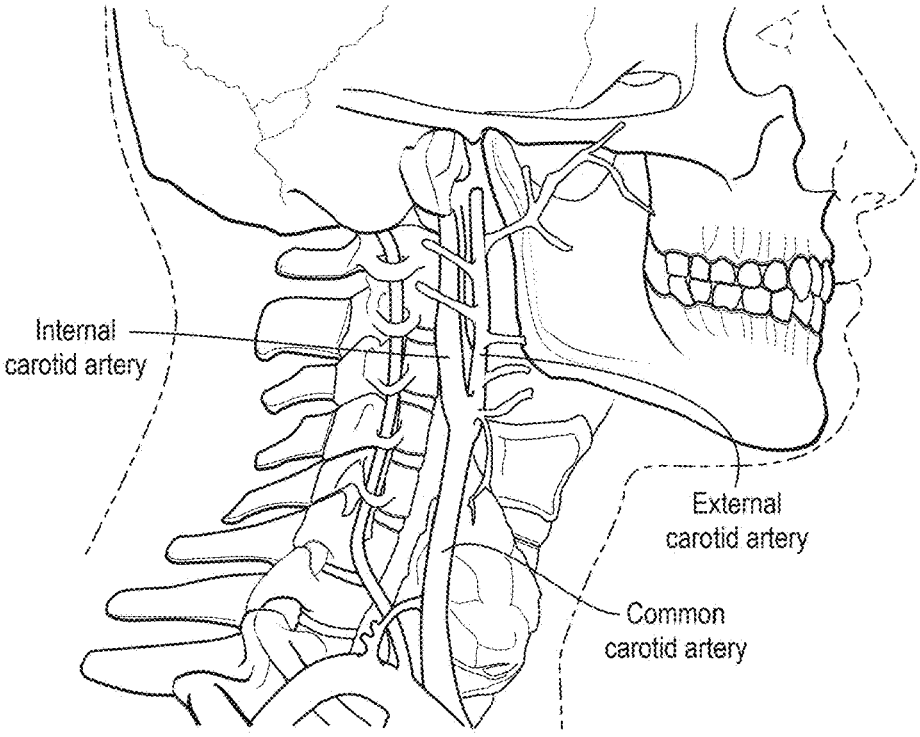
FIG. 2 PRIOR ART
FIG. 2 is a prior art diagrammatic side view of a common, internal, and external carotid arteries in human anatomy.

Turning now to the drawings, FIG. 1 is a diagrammatic front view of the neck venous system in human anatomy, and FIG. 2 is a diagrammatic side view of a common, internal and external carotid arteries in human anatomy. As illustrated in these drawings, vascular anatomy at risk extends from just above the clavicle (collar bone), to the area behind the angle of the mandible near the ear lobe on both sides of the neck.

Figure 3:
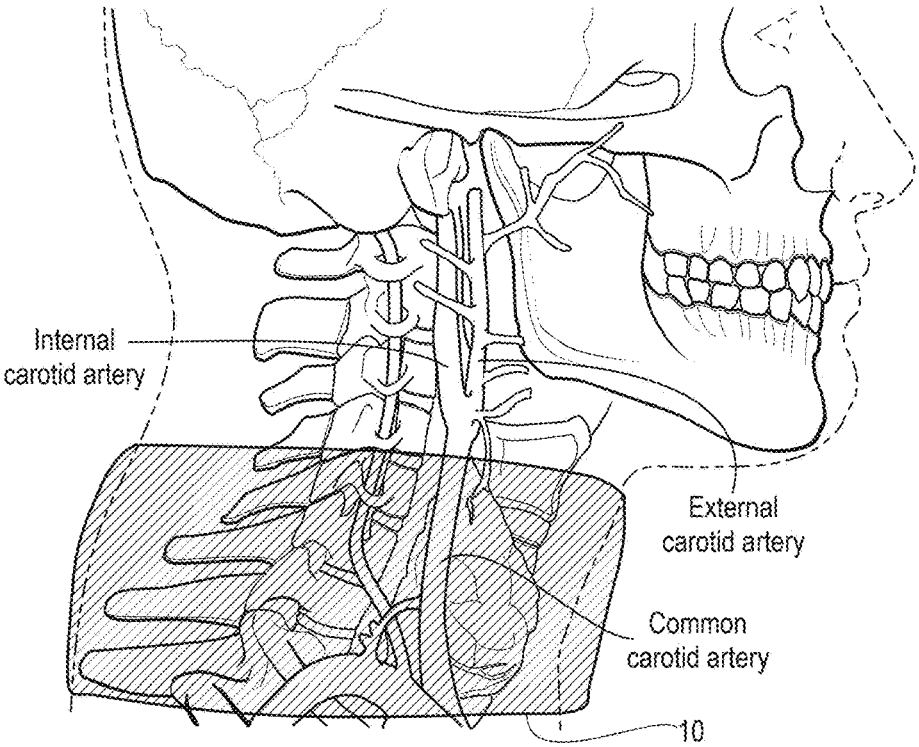
FIG. 3 PRIOR ART
FIG. 3 is the diagrammatic side view of FIG. 2 with a prior art neck guard superimposed thereon.
Figure 4:
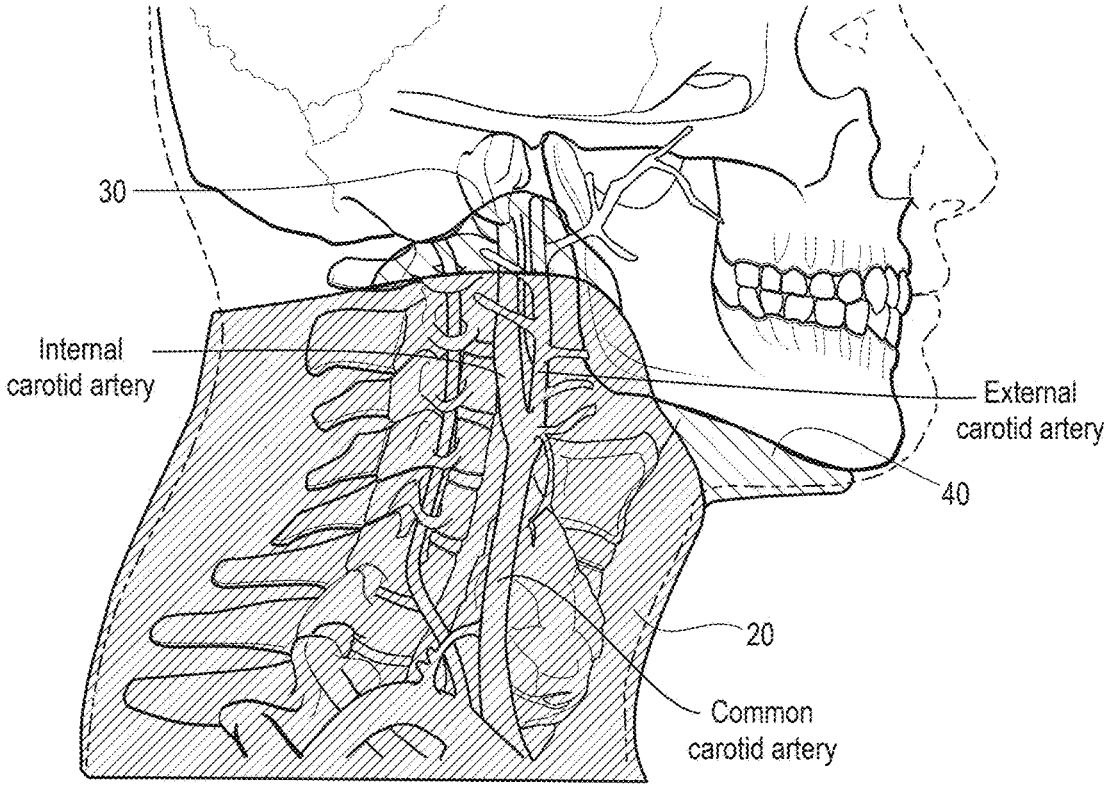
FIG. 4 PRIOR ART
FIG. 4 is the diagrammatic side view of FIG. 2 with another prior art neck guard superimposed thereon.

FIGS. 3 and 4 are diagrammatic side views of FIG. 2 with prior art neck guards 10, 20 superimposed thereon. It is important to note that that the "prior art" neck guards depicted in FIGS. 3 and 4 are merely diagrammatic illustrations and are not intended to be an admission of the specific sizes, locations, dimensions, etc. of actual neck guards in the market today. So, "prior art" in this context is merely used to distinguish classes of neck guards that have coverage different from the neck laceration prevention devices of the embodiments described below.

Turning first to FIG. 3, the neck guard 10 shown in that diagram protects part of the common carotid artery, but it does not protect the internal carotid artery or the external carotid artery. As such, this neck guard 10 can provide inferior anatomic coverage. The neck guard 20 in FIG. 4 provides more coverage than the neck guard 10 in FIG. 3, as it is longer and covers more of the neck. However, while better than the neck guard 10 in FIG. 3, the neck guard 20 in FIG. 4 still may still not provide sufficient anatomic coverage. Also, the "wing" portions that extend at the top of the neck guard 20 may sag down after getting wet with sweat, for example, or after several wash cycles. Further, if the neck guard 20 is used with or attached to a helmet and the helmet becomes dislodged during contact, that will impact the position of the neck guard 20 and can lead to significant vascular exposure.

One area of insufficient anatomic coverage shown in FIG. 4 is the superior aspect of the player's vascular structures 30 inferior to the base of skull entry. Once at the base of the skull, vascular structures are protected and are fairly deep. However, a sharp skate is a shaft skate, and the indicated area of vascular structures 30 are at risk. Also, if lacerated, given that the vascular structures 30 are deeper, it would be very difficult to apply pressure to stop bleeding (it is easier to stop bleeding mid-neck because the vessels there are more superficial/closer to the skin). Another area of insufficient anatomic coverage shown in FIG. 4 is the player's exposed submental/submandibular region 40 (the soft tissue under the chin). The submental/submandibular region 40 is the area under the jaw that is formed by the inferior border of the mandible, the anterior belly of the digastric muscle, and the posterior belly of the digastric muscle.

Figure 5:
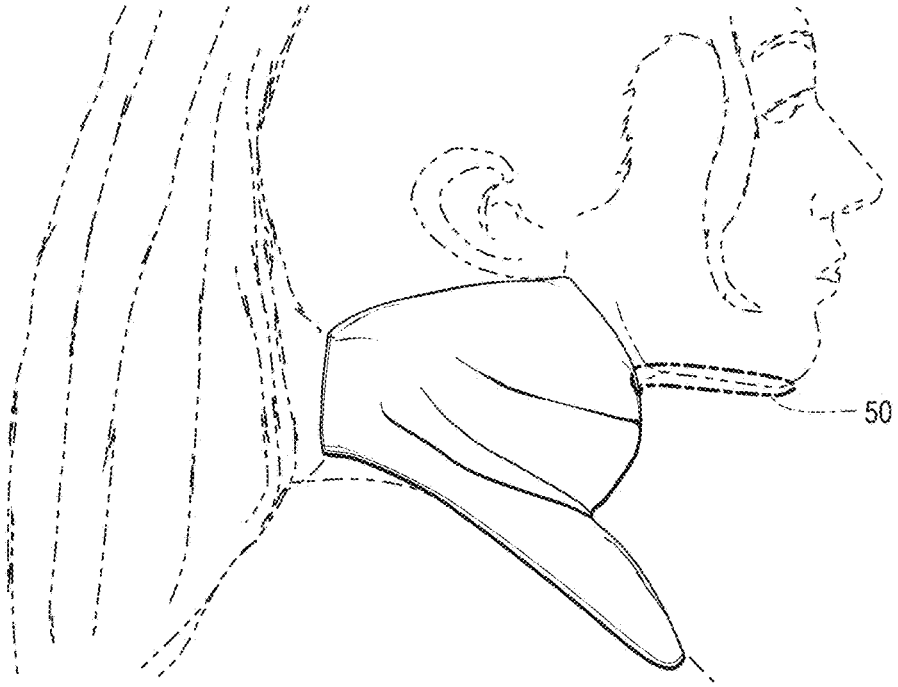
FIG. 5 PRIOR ART
FIGS. 5-7 are illustrations of prior art neck guards.
Figure 6:
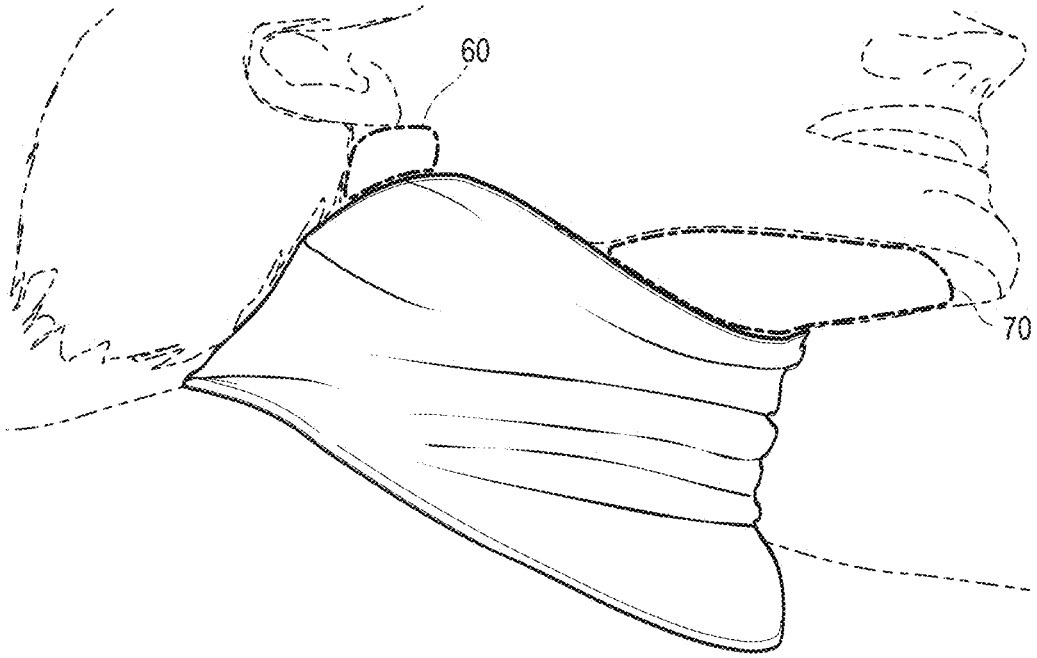
FIG. 6 PRIOR ART
Figure 7:
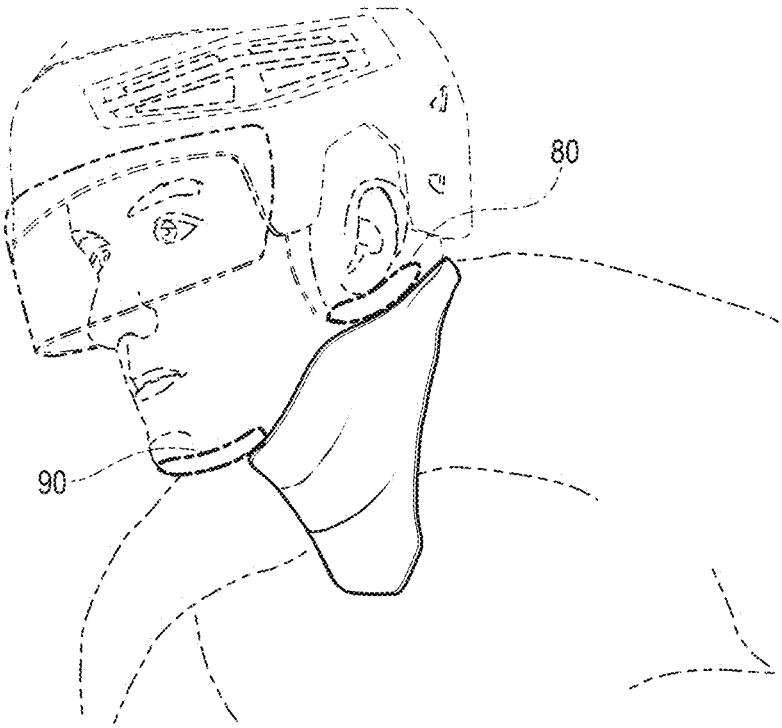
FIG. 7 PRIOR ART

FIGS. 5-7 are illustrations of prior art, commercially-available neck guards that further illustrate these areas of insufficient anatomic coverage. In the neck guard shown in FIG. 5, the submental/submandibular region 50 is exposed. In the neck guards shown in FIGS. 6 and 7, both the vascular structures regions 60, 80 inferior to the base of skull entry, as well as the submental/submandibular regions 70, 90 are exposed.

Figure 8:
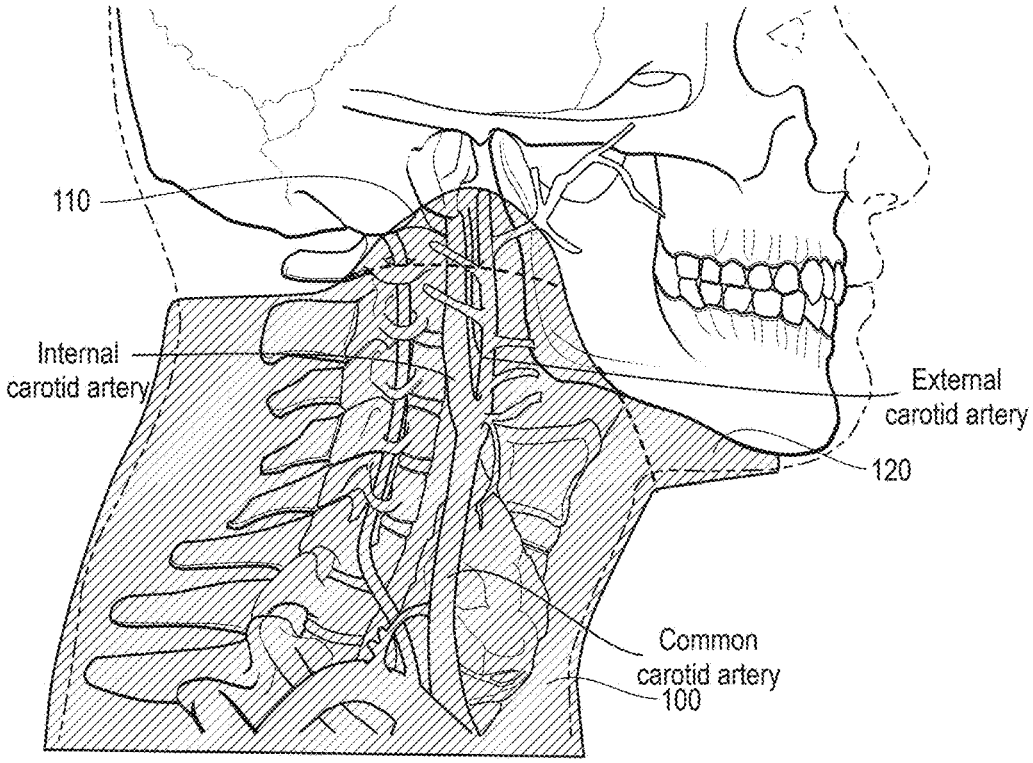
FIG. 8 is the diagrammatic side view of FIG. 2 with a neck laceration prevention device of an embodiment superimposed thereon.

The following paragraphs describe neck laceration prevention devices of embodiments that can overcome the problems described above. Turning again to the drawings, FIG. 8 is the diagrammatic side view of FIG. 2 with a neck laceration prevention device 100 of an embodiment superimposed thereon. As shown in FIG. 8, the neck laceration prevention device 100 of this embodiment provides better anatomic coverage as compared to the prior neck guards described above. More specifically, the neck laceration prevention device 100 of this embodiment protects both the vascular structures 110 inferior to the base of skull entry, as well as the submental/submandibular regions 120. (The neck laceration prevention device 100 in this example also extends inferiorly to the collar bone.) The external carotid artery is just next to the upper jaw bone and is exposed because it is posterior (rearward) of the bone. If it was inside or medial to the jaw bone, it would be protected, but it is not in the majority of humans. As such, it may be desired to cover the earlobe area. However, protection may not be needed of the ear-only up to and including lobe area 110. The neck laceration prevention device 100 can go anterior along the jaw line to cover the submandibular/submental region 120 and then go posterior back and dip a bit just to below the base of the skull. This protects other structures, such as muscles of the neck and other soft tissues including skin.

It should be noted that while the neck laceration prevention device 100 in this embodiment protects both areas 110, 120, in other embodiments, the neck laceration prevention device 100 may protect one but not both of the areas 110 (i.e., the vascular structures 110 inferior to the base of skull entry but not the submental/submandibular regions 120, or vice-versa. Also, in some embodiments, the portions of the neck laceration prevention device 100 that protect one or both areas 110, 120 can be removably attachable to provide a "plug-and-play" option that allows a player to choose which area(s) 110, 120 to cover. For example, a player with a big beard may not want submandibular coverage and, as such, can remove/not attach the portion of the neck laceration prevention device 100 that would protect area 120.

The neck laceration prevention device can be a "stand-alone" device (similar to a neck guard). However, if implemented as a stand-alone device, it is possible that the portions of the neck laceration prevention device that cover the vascular structures inferior to the base of skull entry and/or the submental/submandibular regions can move out of position. For example, the portions that cover the vascular structures inferior to the base of skull entry can become wet with sweat and sag down, for example. Also, the portion that covers the submental/submandibular regions can "scrunch up" and move lower down on the neck.

While the neck laceration prevention device can be made of a sufficiently-stiff material to prevent such movement, a very stiff material may be uncomfortable to the player. So, in one example implementation, the neck laceration prevention device comprises a protective portion with a cut-resistant material and a support portion that is attached to the protective portion, where the support portion is used to reliably secure and cover the at-risk areas with the protective portion (i.e., to maintain consistent placement of the protective portion). (As used herein, "attached to" can mean directly attached to or indirectly attached to via one or more components which may or may not be mentioned herein; "attached to" can also mean integrated with.) The support portion can also secure against movement of the neck laceration prevention device due to helmet movement. While the support portion can be made of the same (or similar) cut-resistant material as the protective portion, in one example implementation, the support portion comprises a different material, which may be more comfortable or flexible. Further, the support portion can take any suitable configuration or form.

The following paragraphs provide examples of several different types of implementations. It is important to note that these are merely examples and that other types of implementations can be used. As such, the details presented herein should not be read into the claims unless expressly recited therein.

Figure 9:
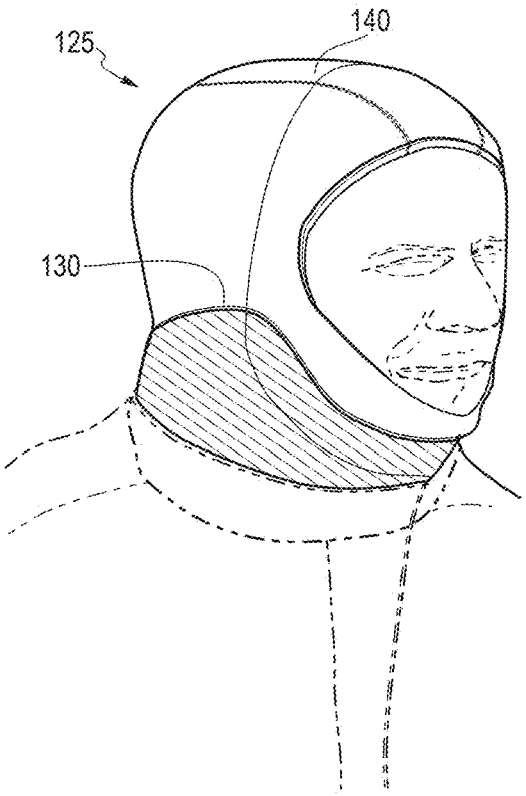
FIG. 9 is an illustration of a neck laceration prevention device of an embodiment that comprises a balaclava.

Turning again to the drawings, FIG. 9 illustrates a neck laceration prevention device 125 of an embodiment where the protective portion 130 is attached to the support portion 140 (here, a balaclava). For example, the protective portion 130 can be sewn onto a balaclava 140, and an additional layer of thin fabric can be sewn over the protective portion 130 for aesthetics and to provide a soft feel (so, the protective portion 130 would be a "middle layer"). Because of the cut-resistive nature of the protective portion 130, a laser may be needed to cut the material for the protective portion 130 from a large swath of the material, and a diamond-tipped needle may be needed to sew the protective portion 130 onto the balaclava 140 (or other types of support portions). The balaclava 140 acts as a support system to ensure superior anatomic vascular protection by the protective portion 130. It should be noted that the design of the neck laceration prevention device 125 can be different from what is shown in FIG. 9 (e.g., with the neck laceration prevention device 125 terminating below instead of above the chin). Also, in some implementations, the bottom portion of the balaclava 140 in the back of the neck has a vertical seam with hook-and-loop fasteners (e.g., Velcro®) to accommodate different neck sizes. Also, a four-inch horizontal or vertical seam can be integrated into the posterior or rear of 140 above the fastening system to allow for exit of long hair. Further, while the balaclava 140 can be a "solo" hood design, the balaclava 140 can be a hood design that is attached to an undergarment (e.g., a comfortable, long-sleeve shirt with wicking capability and the flexibility to conform to body habitus). When attached to an undergarment, cut-resistance material can also be attached to the bottom portion of the undergarment to serve as wrist protection (e.g., spanning about seven inches from the bottom of the shirt sleeve). Small vents can be introduced on either side of 130 in the neck region for air flow to the neck while the player is moving without compromising neck laceration protection. Further, 140 may be of a mesh-like material or have fenestrations to assist with temperature regulation.

Figure 10:
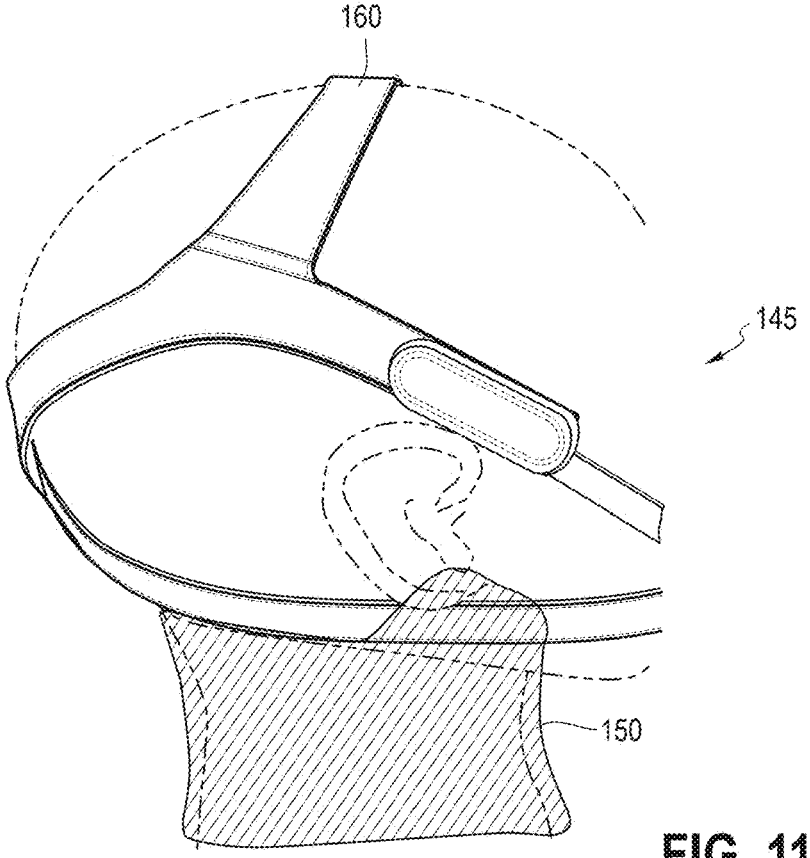
FIGS. 10 and 11 are illustrations of neck laceration prevention devices of embodiments that comprise a head strap.
Figure 11:
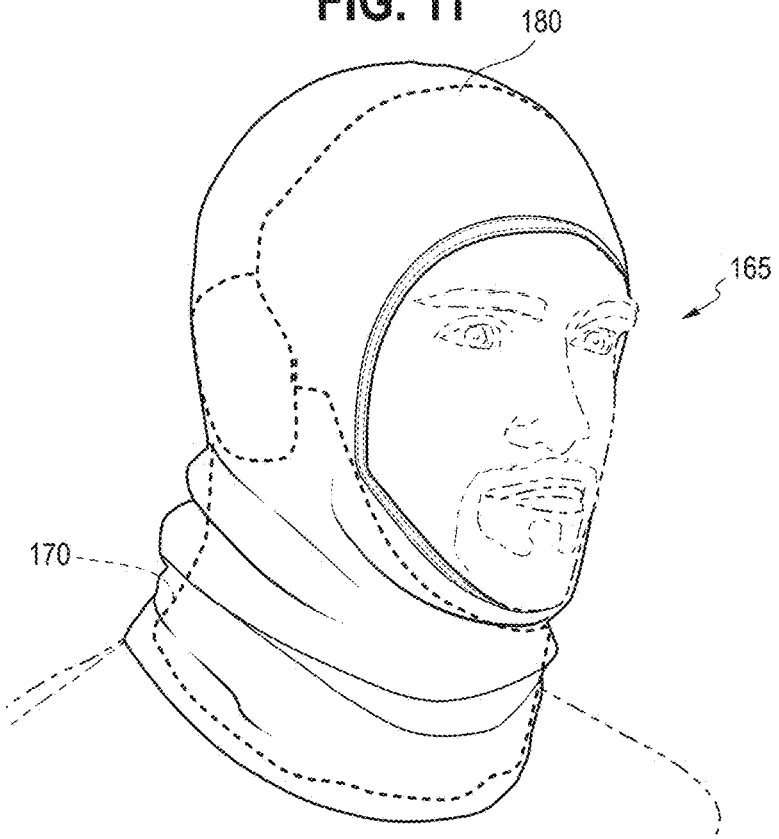

Other implementations are possible. For example, as shown in the neck laceration prevention device 145 in FIG. 10, the support portion 160 can take the form of a head strap that is attached to the protective portion 150. This embodiment may be preferred by players who do not want to wear a balaclava. The head strap can be made of the same or different material as that of the protective portion 150. As yet another example, in the neck laceration prevention device 165 in FIG. 11, the support portion 180 takes the form of a head strap that is attached to the protective portion 170, which takes the form of a solo gaiter/bottom half of a balaclava/hood. (FIG. 11 shows the neck laceration prevention device 165 superimposed over a balaclava for comparison.) Instead of being a solo gaiter, the neck laceration prevention device 165 can be attached to an undergarment shirt, as described above.

By way of a non-limiting example, the following are approximate example dimensions of a neck laceration prevention device for a six-foot-tall male weighting 210 pounds, where the protective material is sewn onto a balaclava, so the cut-resistance material will not touch the skin. These measurements are descriptive to account for differing anatomies and corresponding measurements.

Figure 13:
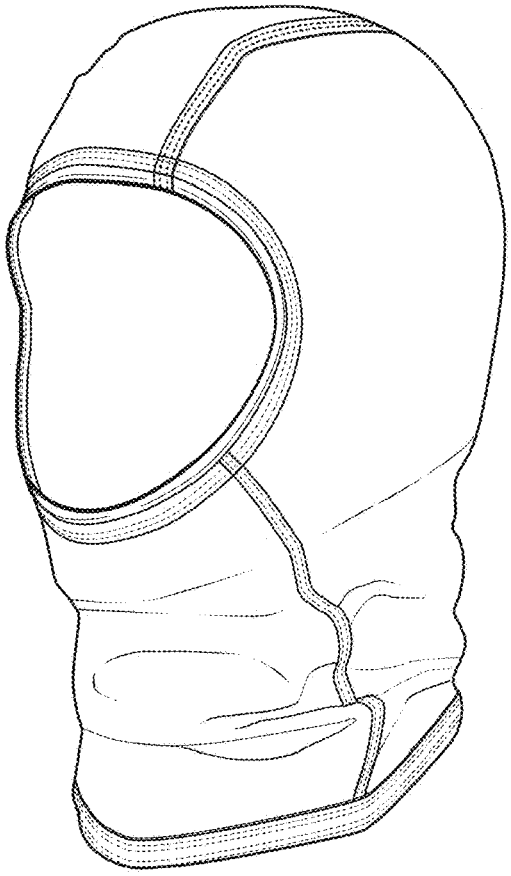
FIG. 13 PRIOR ART
FIG. 13 is an illustration of a prior art balaclava

From collar bone to top of head which would incorporate the support system and protective device: 12 inches Protective material from collar bone to base of skull: 6 inches Protective material back of neck to front of neck: 6 inches Protective material side of neck to side: 5 inches Protective material circumference of neck: 16 inches Protective material covering submandibular region 2.5 inches from upper neck to skin of anterior lower chin, and 2.5 inches left to right at upper neck narrowing to 1 inch at tip of chin Turning again to the drawings, FIG. 13 is an illustration of a prior art balaclava, and FIGS. 14-17 show different modifications that can be made with respect to that balaclava for different example implementations of neck laceration prevention devices of these embodiments. Of course, these are only examples, and other modifications can be made. In FIGS. 14-17, the non-shaded portions of the balaclava represent the shape of the human head, facial area, and skin.

Figure 14:
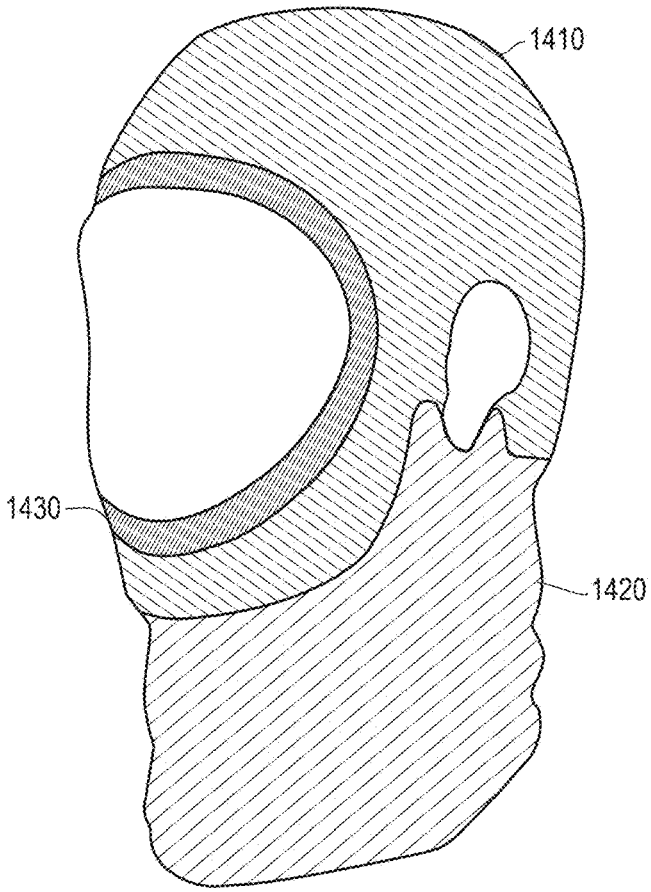
FIGS. 14-17 are illustrations of various configurations of neck laceration prevention devices of an embodiment.

FIG. 14 shows a "balaclava support" embodiment that can be a standalone design or integrated into a shirt. Portion 1410 can be breathable/elastic/sweat-wicking/anti-microbial (e.g., COOLMAX32) and can also be a cut-resistant material. Portion 1420 can be a cut-resistant material (e.g., Cutlon®). Portion 1430 can be elastic stitching/support.

Figure 15:
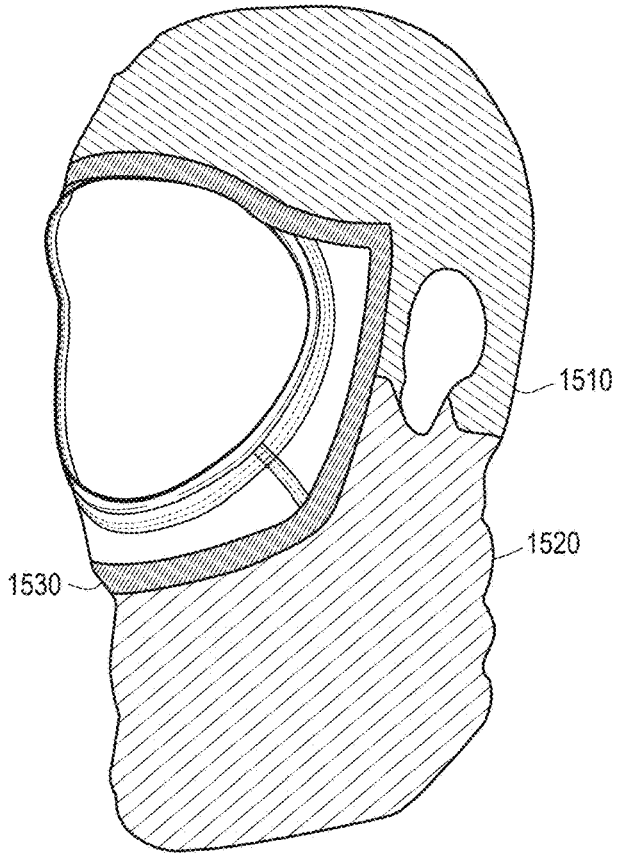

FIG. 15 shows a "chin skully support" embodiment that can be a standalone design or integrated into a shirt. Portion 1510 can be breathable/elastic/sweat-wicking/anti-microbial (e.g., COOLMAX32) and can also be a cut-resistant material. Portion 1520 can be a cut-resistant material (e.g., Cutlon®). Portion 1530 can be elastic stitching/support.

Figure 16:
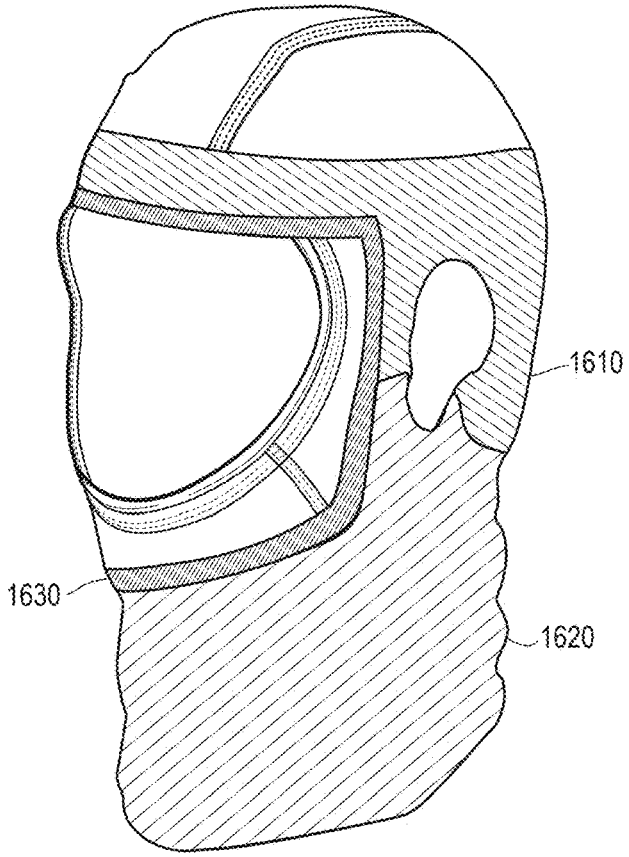

FIG. 16 shows a "crown strap support" embodiment that can be a standalone design or integrated into a shirt. Portion 1610 can be breathable/elastic/sweat-wicking/anti-microbial (e.g., COOLMAX32) and can also be a cut-resistant material. Portion 1620 can be a cut-resistant material (e.g., Cutlon®). Portion 1630 can be elastic stitching/support.

Figure 17:
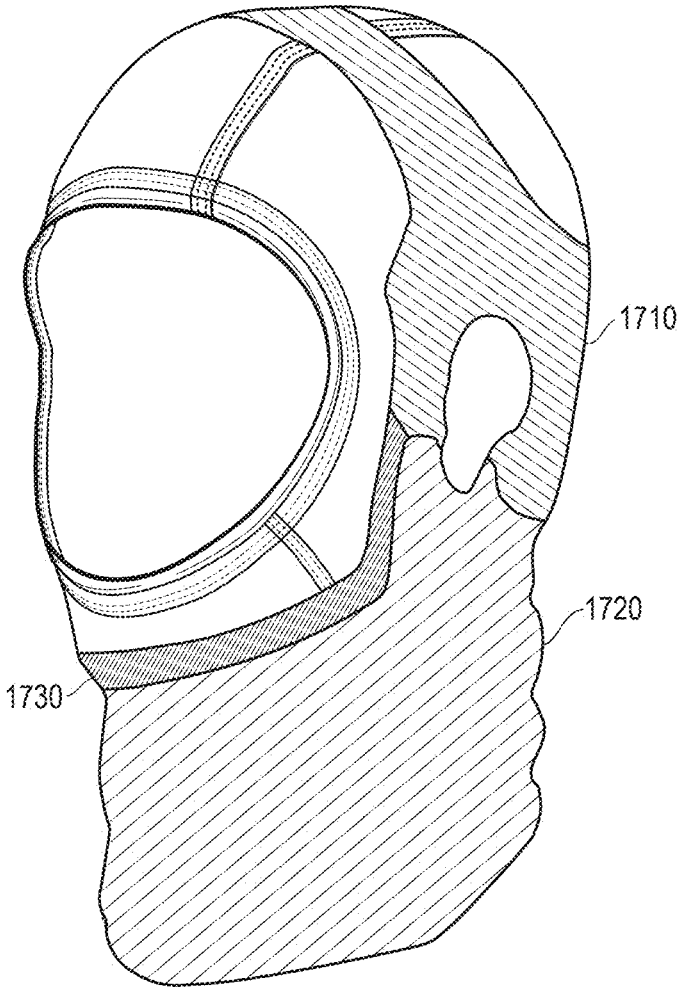

FIG. 17 shows a "overhead strap support" embodiment that can be a standalone design or integrated into a shirt. Portion 1710 can be breathable/elastic/sweat-wicking/anti-microbial (e.g., COOLMAX32) and can also be a cut-resistant material. Portion 1720 can be a cut-resistant material (e.g., Cutlon®). Portion 1730 can be elastic stitching/support.

Figure 12:
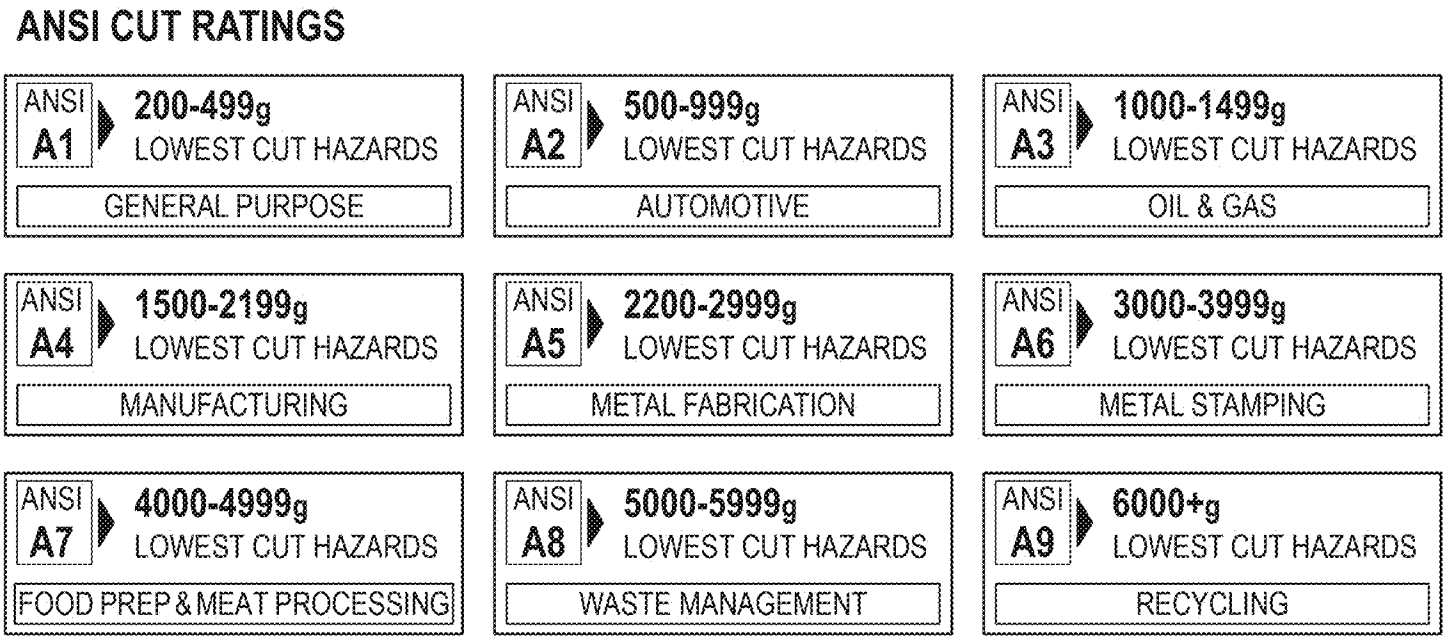
FIG. 12 PRIOR ART
FIG. 12 is an illustration of prior art American National Standards Institute (ANSI) cut ratings.

As described above, the neck laceration prevention device of these embodiments comprises a protective portion with a cut-resistant material. Any suitable type of cut-resistant material can be used. As illustrated in FIG. 12, the American National Standards Institute (ANSI) provides a variety of cut ratings. It may be desired to choose a material with an ANSI cut rating that can prevent a skate blade with proper force and angle from cutting into the material. However, choosing a material with too high of an ANSI cut rating may make the neck laceration prevention device too inflexible and cumbersome for a hockey player to use. Also, the difference between ANSI ratings may not be practically significant. For example, A5 requires approximately five pounds of pressure to cut over 20 cm to cut, whereas A8 requires approximately 11 pounds of pressure over 20 cm to cut, and most slash injuries are likely to be less than this amount of pressure. In one example implementation, a cut-resistant material of ANSI A5 or above (e.g., A6) is used (e.g., ASTM F-2992-15 Blade Cut Resistance Level A5). In another example implementation, a cut-resistant material of ANSI A4 or above (e.g., A4-A9) is used. Of course, there are merely examples, and other materials deemed to be suitable can be used.

One material that can be considered is Cut-Tex® PRO, which is an exceptionally-durable cut-resistant fabric that is five-times stronger than Kevlar. Cut-Tex® PRO is an ultra-high cut-resistant fabric that is knitted from an innovative combination of ultra-high molecular weight polyethylene (UHMWPE) and other technical fiber weaved by special high-density knitting machines (e.g., a UK-based ISO 9001: 2008 quality standard accredited manufacturing facility). Another material that can be considered is SpectraGuard™, which is used in some currently-available neck guards. SpectraGuard™ fiber has a tensile strength 23% higher than Kevlar. It is important to note that these materials are merely examples and that any suitable type of material can be used. For example, in other embodiments, Cutlon® is used. Cutlon® is cut-resistant, lightweight, thin, can be provided in a range of colors, and has elastic/stretch capability. Because Cutlon® is thin, Cutlon® can allow for more comfort and better heat dissipation that thicker materials. Further, its elasticity allows for it to be placed over the head more easily than thicker and less-compliant material. This compliance feature may also obviate the need for hook-and-loop fasteners (e.g., Velcro®) or other types of fastening mechanisms in the back of the device for proper fitting.

There are several advantages associated with these embodiments. For example, the neck laceration prevention devices described herein provide better anatomical coverage than the neck guards that are currently available. As discussed above, one example implementation of a neck laceration prevention device can position cut-resistant material in such a way as to provide complete vascular coverage to the base of the skull and/or coverage of the submental/submandibular region. The neck laceration prevention devices can be made to be comfortable and provide the mobility desired by hockey players. Also, the support portion (stabilization system) can be made to be comfortable and can be designed with multiple configurations to accommodate player preference (e.g., mesh or fenestrations as noted above).

There are several other advantages associated with these embodiments. For example, the level of safety and effectiveness of the neck laceration prevention device of these embodiments may lead to mandates from the National Hockey League and other leagues/organizations that currently do not have mandates for laceration prevention. Additionally, the level of safety and effectiveness of the neck laceration prevention device of these embodiments may lead to the establishment of a certification standard for neck laceration prevention devices. Further, the style and comfort of the support structures of the neck laceration prevention devices of these embodiments may encourage players who currently do not wish to wear a neck guard to wear the neck laceration prevention device.

It is intended that the foregoing detailed description be understood as an illustration of selected forms that the invention can take and not as a definition of the invention. It is only the following claims, including all equivalents, that are intended to define the scope of the claimed invention. Finally, it should be noted that any aspect of any of the embodiments described herein can be used alone or in combination with one another.

What is claimed is:

1. A neck laceration prevention device comprising:

a protective portion comprising a cut-resistant material, wherein the protective portion is shaped to protect vascular structures inferior to a base of skull entry and/or a submental/submandibular region; and a support portion attached to the protective portion, wherein the support portion is configured to maintain a position of the protective portion;

wherein the support portion comprises a balaclava attached to an undergarment.

2. The neck laceration prevention device of claim 1, wherein the undergarment comprises a cut-resistant wrist protector.

3. A neck laceration prevention device comprising:

a protective portion comprising a cut-resistant material, wherein the protective portion is shaped to protect vascular structures inferior to a base of skull entry and/or a submental/submandibular region; and a support portion attached to the protective portion, wherein the support portion is configured to maintain a position of the protective portion;

wherein the support portion comprises a head strap; and wherein the protective portion comprises a gaiter attached to an undergarment.

4. The neck laceration prevention device of claim 3, wherein the undergarment comprises integrated cut-resistant wrist protectors.

5. A neck laceration prevention device comprising:

a protective portion comprising a cut-resistant material, wherein the protective portion is shaped to protect vascular structures inferior to a base of skull entry and/or a submental/submandibular region; and a support portion attached to the protective portion, wherein the support portion is configured to maintain a position of the protective portion;

wherein the protective portion comprises a first sub-portion shaped to protect the vascular structures inferior to the base of skull entry and a second sub-portion shaped to protect the submental/submandibular region, wherein at least one of the first and second sub-portions are removably attachable to the neck laceration prevention device.

* * * * *